US009033476B2

(12) United States Patent
Kanbe et al.

(10) Patent No.: US 9,033,476 B2
(45) Date of Patent: May 19, 2015

(54) PROTECTIVE CAP

(71) Applicant: Brother Kogyo Kabushiki Kaisha, Nagoya, Aichi-Ken (JP)

(72) Inventors: Tomohiro Kanbe, Nagoya (JP); Masayuki Takata, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/322,211

(22) Filed: Jul. 2, 2014

(65) Prior Publication Data

US 2015/0070445 A1 Mar. 12, 2015

(30) Foreign Application Priority Data

Sep. 9, 2013 (JP) ..... 2013-186012

(51) Int. Cl.
*B41J 2/175* (2006.01)
*B41J 2/165* (2006.01)

(52) U.S. Cl.
CPC ..... *B41J 2/175* (2013.01); *B41J 2/17533* (2013.01); *B41J 2/16505* (2013.01)

(58) Field of Classification Search
CPC .. B41J 2/17522; B41J 2/17536; B41J 2/1752; B41J 2/1754; B41J 2/16505; B41J 2/16511
See application file for complete search history.

(56) References Cited

U.S. PATENT DOCUMENTS

| | | | | |
|---|---|---|---|---|
| 5,448,274 | A * | 9/1995 | Hirabayashi et al. | 347/86 |
| 2002/0012019 | A1 | 1/2002 | Seino | |
| 2007/0229625 | A1 | 10/2007 | Yano | |

FOREIGN PATENT DOCUMENTS

| | | |
|---|---|---|
| JP | 2002-79690 | 3/2002 |
| JP | 2005-238857 | 9/2005 |
| JP | 2007-268980 | 10/2007 |
| JP | 2009-132098 | 6/2009 |

* cited by examiner

*Primary Examiner* — Juanita D Jackson
(74) *Attorney, Agent, or Firm* — Frommer Lawrence & Haug LLP

(57) ABSTRACT

There is provided a protective cap configured to be installed into a liquid cartridge installation section having a liquid supply tube in fluid connection with a recording head for jetting a liquid via a flexible tube. The protective cap includes: an chamber defined by a case in a liquid-tight manner; a liquid absorbing member filled in the chamber; a connecting portion having a connecting channel in communication with the chamber and configured to be connected with the liquid supply tube; and an atmosphere communication portion via which the chamber communicates an outside of the case.

14 Claims, 10 Drawing Sheets

PROTECTIVE CAP

CROSS REFERENCE TO RELATED APPLICATION

The present application claims priority from Japanese Patent Application No. 2013-186012, filed on Sep. 9, 2013, the disclosure of which is incorporated herein by reference in its entirety.

BACKGROUND OF THE INVENTION

1. Field of the Invention

The present invention relates to a protective cap which is configured to be installed into a liquid cartridge installation section having a liquid supply tube in fluid connection with a recording head for jetting a liquid via a flexible tube.

2. Description of the Related Art

Conventionally, in an image recording apparatus using a so-called tube supply method, an ink cartridge is arranged outside of a carriage carrying a recording head, while the ink cartridge and the recording head are connected via a tube. The ink cartridge is, for example, installed into a cartridge installation section having an opening in the front side of the apparatus body, via the opening in a horizontal direction. The cartridge installation section accommodates the ink cartridge in an insertable and removable manner. With the ink cartridge installed in the cartridge installation section, ink flow channels are formed from the ink cartridge to the nozzles of the recording head. Through these ink flow channels, ink is supplied from the ink cartridge to the recording head, and jetted from the nozzles of the recording head.

In order to cause the ink contained in the ink cartridge to flow out of the ink cartridge, the cartridge installation section is provided with an ink tube and the like referred to as an ink needle and the like. With the ink tube inserted into the ink cartridge, it becomes possible for the ink contained in the ink cartridge to flow out through the ink tube.

During transportation of the image recording apparatus such as when the image recording apparatus is shipped out, its setup place is changed, etc., in order to prevent any leakage of the ink contained in ink cartridge, the image recording apparatus is sometimes transported with the ink cartridge removed from the cartridge installation section. Further, even if the ink cartridge is removed from the cartridge installation section, it is still possible for some of the ink remaining in the ink flow channel such as the tube, recording head and the like to leak from the ink tube. Therefore, when transporting the image recording; apparatus, a protective cap, instead of the ink cartridge, is sometimes installed in the cartridge installation section.

SUMMARY OF THE INVENTION if there is some air existing in the ink flow channel such as the recording head, tube and the like in which the ink is remaining, it is possible for the air in the ink flow channel to undergo an increase or decrease in volume and pressure in accordance with a change in temperature or atmospheric pressure during the transportation of the image recording apparatus. If the air in the ink flow channel undergoes an increase or decrease in volume, the ink remaining in the ink flow channel is moved by the air. However, if the protective cap covers up the ink tube which is at one end side of the ink flow channel, because of destruction of ink meniscuses formed in the nozzles of the recording head which is at the other end side of the ink flow channel, it is feared that the ink leaks out of the nozzles. Further, it is feared that the leak-out ink of multiple colors is sucked into the recording head after the colors are mixed together. As a result, it is possible to give rise to a color mixture of the ink in the recording head.

On the other hand, in a case that the ink tube is not covered up by the protective cap or the like in a liquid-tight manner, if the ink meniscuses are broken in the nozzles, there is fear that much of the ink remaining in the ink flow channel leaks out of the ink tube. Especially, in an image recording apparatus adopting a tube supply method with a long ink flow channel, a large amount of the ink may leak out.

The present invention was made in view of the situations mentioned above, and an object thereof is to provide a means capable of restraining color mixture or leakage of a liquid such as ink or the like even if a change occurs in the external environment of an image recording apparatus.

According to an aspect of the present invention, there is provided a protective cap configured to be installed into a liquid cartridge installation section having a liquid supply tube in fluid connection with a recording head for jetting a liquid via a flexible tube, the protective cap including: an chamber defined by a case in a liquid-tight manner; a liquid absorbing member filled in the chamber; a connecting portion having a connecting channel in communication with the chamber and configured to be connected with the liquid supply tube; and an atmosphere communication portion via which the chamber communicates with an outside of the case.

If the protective cap is installed into the liquid cartridge installation section, the connecting portion is connected with the liquid supply tube. Because the atmosphere communication portion allows the chamber in communication with the connecting channel of the connecting portion to communicate with the outside of the case, if there is any increase in the volume or pressure of the air in the recording head and tube, the liquid flows into the chamber through the connecting channel. Therefore, it is possible to restrain the liquid from leaking out of the recording head due to destruction of meniscus of the liquid. Further, the liquid flowing into the chamber is absorbed by the liquid absorbing member. Therefore, it is possible to restrain the liquid from leaking out of the ease.

According to the present invention, even if a change occurs in the external environment of the image recording apparatus, no liquid will leak out of the recording head and, furthermore, the liquid flowed into the chamber from the tube will not leak out of the protective cap. Therefore, it is possible to restrain color mixture and leakage of the liquid.

BRIEF DESCRIPTION OF THE DRAWINGS

FIGS. 10A to 10H are schematic views showing a process of the protective cap retaining a liquid, wherein FIGS. 10A, 10C, 10E, and 10G are front views of the protective cap while FIGS. 10B, 10D, 10F and 10H are cross-sectional views of the protective cap.

DESCRIPTION OF THE EMBODIMENT

Figure 1:
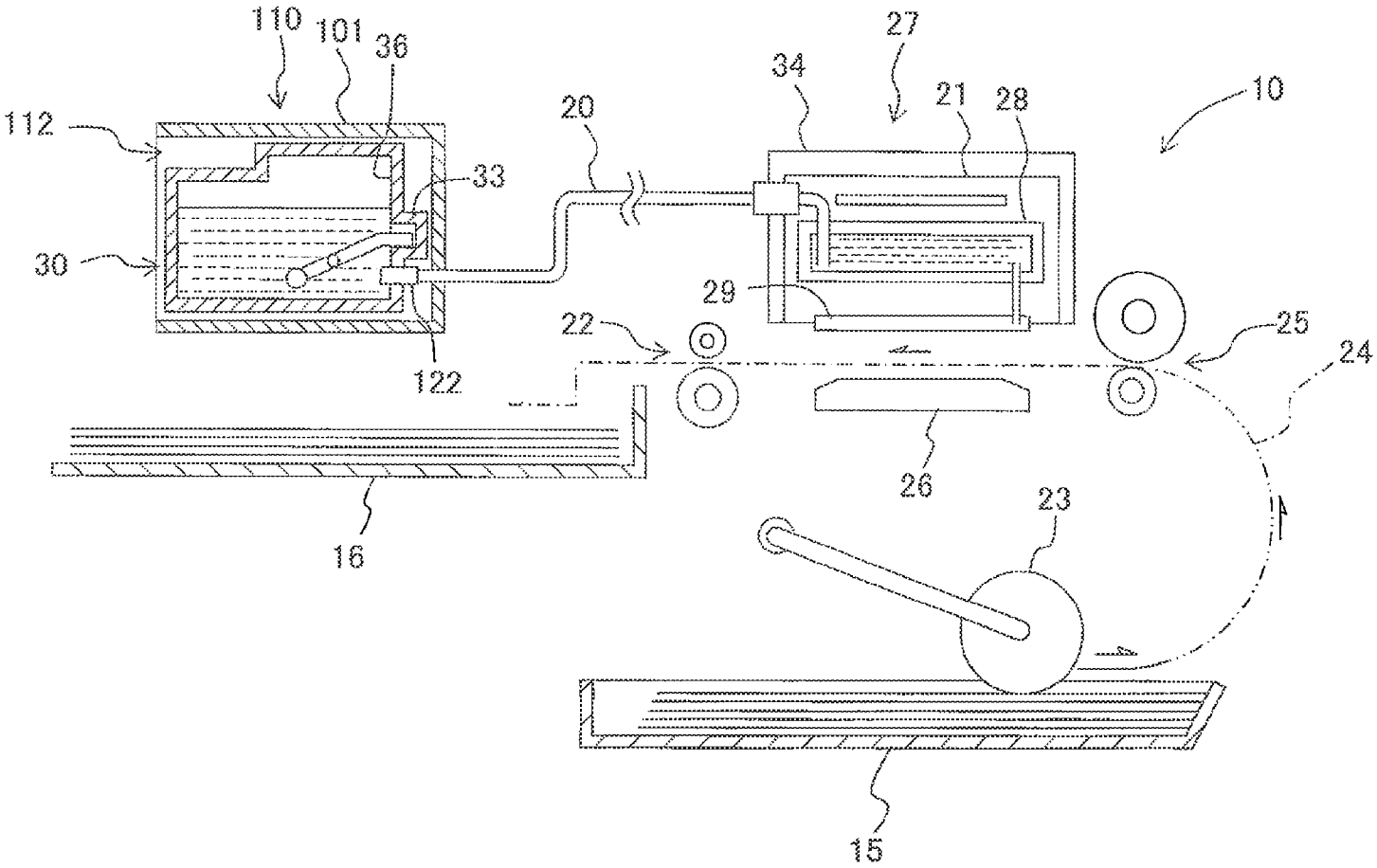
FIG. 1 is a schematic cross-sectional view schematically showing an internal structure of a printer including a cartridge installation section in accordance with an embodiment of the present invention.

Hereinbelow, referring to the accompanying drawings as appropriate, an embodiment of the present teaching will be explained. Further, the embodiment explained hereinbelow is merely an example of embodying the present teaching, and thus it is possible to change the embodiment as appropriate within the scope of not departing from the gist or substance of the present teaching.

Further, in the following explanation, the direction of gravitational force is defined as an up-down direction 52 in such a state and posture that an ink cartridge 30 is installed in a cartridge installation section 110 and a printer 10 is usable. Further, in the above state and posture, an insertion and removal direction 50 of the ink cartridge 30 into and from the cartridge installation section 110 is defined as a front-rear direction 53. Further, the direction orthogonal to the up-down direction 52 and to the front-rear direction 53 is defined as a left-right direction 51.

<Printer 10>

As shown in FIG. 1, the printer 10 records images by selectively jetting ink droplets onto a sheet of recording paper or the like based on an ink jet recording method. The printer 10 includes the cartridge installation section 110 and a recording section 27.

A plurality of ink cartridges 30, in which inks having different colors are stored respectively, may be installed in the cartridge installation section 110. An opening 112 open to the outside is provided at one side of the cartridge installation section 110. The ink cartridges 30 are inserted into or removed from the cartridge installation section 110 via the opening 112. Further, FIG. 1 shows only one ink cartridge 30.

Each of the ink cartridges 30 stores a liquid such as ink or the like which is usable for the printer 10. If the ink cartridge 30 is installed into the cartridge installation section 110, the ink cartridge 30 is connected with (in fluid connection with) the recording section 27 via a tube 20 so that the ink flows from the ink cartridge 30 to the recording section 27.

The recording section 27 has a carriage 34 and a recording head 21 mounted on the carriage 34. The carriage 34 moves reciprocatingly in a direction perpendicular to the page of FIG. 1 (in a main scanning direction). In detail, the carriage 34 is supported by, for example, two guide rails (not shown) attached to a frame (not shown) provided inside the printer 10. The two guide rails extend in the direction perpendicular to the page of FIG. 1 in the main scanning direction). The carriage 34 is arranged to bridge over the two rails. Although not shown in FIG. 1, the guide rails are provided with a belt drive mechanism, and the carriage 34 is moved in an extending direction of the guide rails (in the main scanning direction) by a driving force transmitted from the belt drive mechanism.

A plurality of nozzles 29 are provided in the lower surface of the recording head 21, and the lower surface of the recording head 21 faces a platen 26. Although not shown in FIG. 1, by the oscillation of piezoelectric elements provided to correspond to the nozzles 29 respectively, ink droplets are selectively jetted from the plurality of nozzles 29. Further, although not shown in any of the drawings, in a position away from the platen 26 in the main scanning direction, a cap is provided to cover the lower surface of the recording head 21 in which the nozzles 29 are provided. This cap may be used to prevent the ink in the nozzles 29 of the recording head 21 from drying, or to carry out a suction (purge) to remove the ink, air bubbles and foreign substances from the nozzles 29.

The recording head 21 is provided with a sub-tank 28. The sub-tank 28 temporarily stores the ink supplied from the ink cartridge 30 through the tube 20. At least a part of one wall of the sub-tank 28 is formed of a flexible film. If a gaseous body in the sub-tank 28 varies in volume due to a temperature change or the like, the film constituting the one wall of the sub-tank 28 flexes to cause volume of the sub-tank 28 to vary. This restrains destruction of the ink meniscuses formed in the nozzles 29 because of the volume variation of the gaseous body in the sub-tank 28 due to the temperature change or the like.

Further, in this embodiment, the recording head 21 mounted on the carriage 34 jets the ink droplets while being moved together with the carriage 34. However, without providing the carriage 34, the recording head 21 may be provided to face the platen 26 over almost the entire area of the platen 26 in the main scanning direction and the ink droplets may be selectively jetted from the recording head 21, so that images are recorded across almost the entire area of a sheet in the main scanning direction without moving the recording head 21 in the main scanning direction.

A feed roller 23 feeds a sheet placed on a feed tray 15 into a transport path 24. A transport roller pair 25 transports the sheet fed into the transport path 24 onto the platen 26. The recording head 21 is arranged to face the platen 26. The recording head 21 selectively jets the ink droplets from the plurality of nozzles 29 onto the sheet passing, through the platen 26. By virtue of this, images are recorded on the sheet. A discharge roller pair 22 discharges the sheet past the platen 26 to a discharge tray 16 provided on the most downstream side of the transport path 24.

<Ink Cartridge 30>

Figure 2:
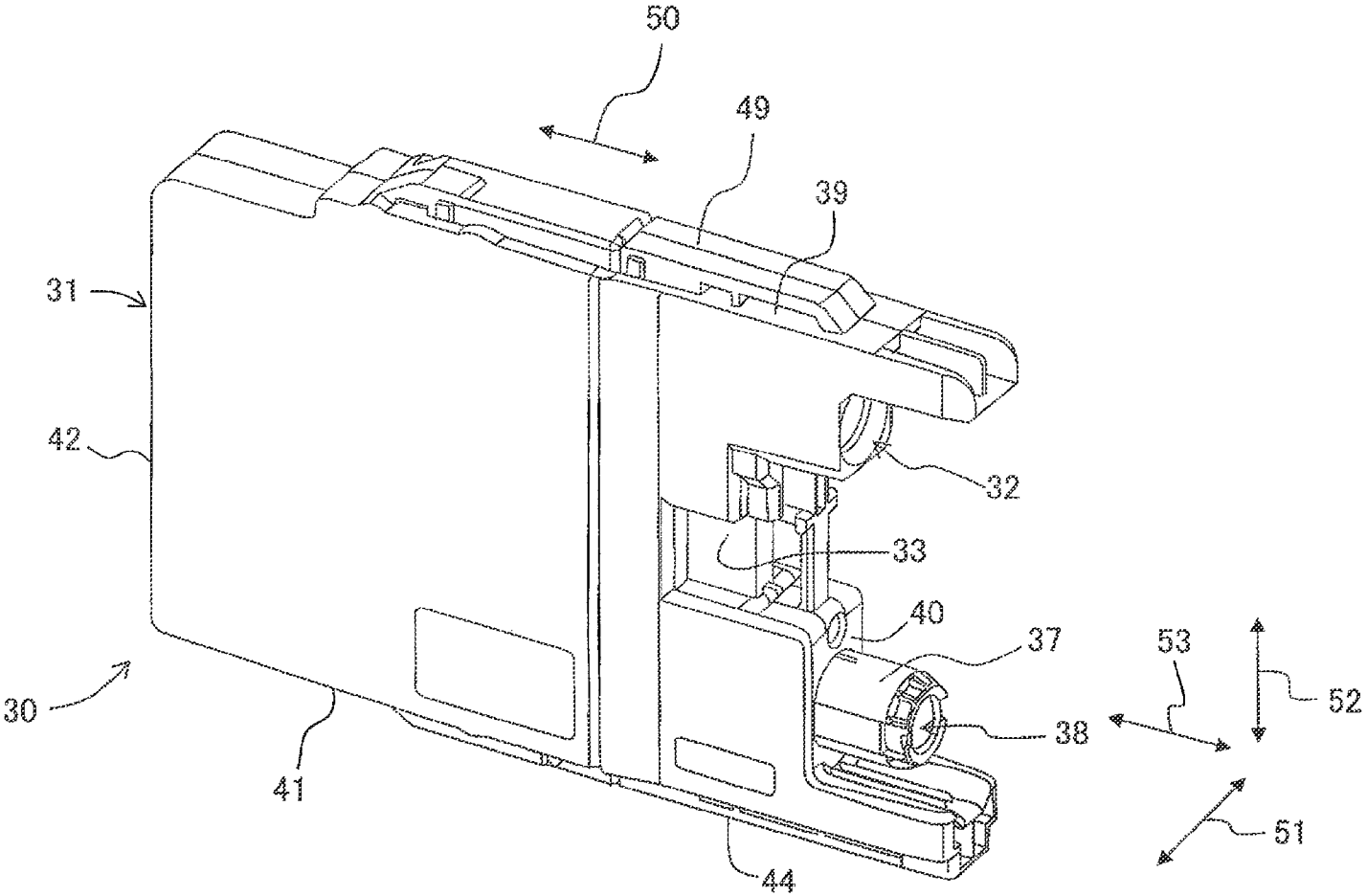
FIG. 2 is a perspective view showing a configuration of an ink cartridge.

As shown in FIGS. 1 and 2, the ink cartridge 30 is a container storing a liquid such as ink or the like. The space formed inside the ink cartridge 30 serves as an ink chamber 36 in which the ink is stored.

In a stand-up state shown in FIG. 2, that is, with the lower surface in the figure as the bottom and the upper surface in the figure as the top, the ink cartridge 30 is inserted into or removed from the cartridge installation section 110 in a direction shown by an arrow 50 (to be referred to as an "insertion and removal direction 50", hereinbelow). The ink cartridge 30 is inserted into or removed from the cartridge installation section 110 while keeping the stand-up state.

The ink cartridge 30 has an approximately box-shaped main body 31. The main body 31 has a flattened shape of a small size in the left-right direction 51 and of larger sizes in the up-down direction 52 and in the front-rear direction 53 than in the left-right direction 51. When the ink cartridge 30 is installed in the cartridge installation section 110, the wall of the main body 31 on its front side (that is, its front side in the front-rear direction 53) is defined as a front wall 40, whereas the wall of the main body 31 on its rear side is defined as a rear wall 42. The front wall 40 and the rear wall 42 overlap at least in part with each other as viewed from the insertion and removal direction 50 (from a longitudinal direction of the ink cartridge 30). Further, the insertion and removal direction 50 is parallel to the front-rear direction 53.

In the vicinity of the center of the front wall 40 of the main body 31 with respect to the up-down direction 52, there is provided a remaining amount detection portion 33 configured to detect whether remaining amount of the ink in the ink chamber 36 is not lower than a predetermined value.

As shown in FIG. 2, an ink supply portion 37 is provided on the front wall 40 of the main body 31 below the remaining amount detection portion 33. The ink supply portion 37 has a cylindrical shape projecting outward from the front wall 40 along the front-rear direction 53. An ink flow passage 38 is formed inside the ink supply portion 37. The ink flow passage 38 is a flow passage which penetrates in the front-rear direction 53 through apart of the wall defining the ink chamber 36 to let the ink flow therethrough. From the ink chamber 36 and through the ink flow passage 38, the ink flows out to an ink needle 122 provided in the cartridge installation section 110 (see FIG. 4).

As shown in FIG. 2, an atmosphere communication port 32 is provided on the front wall 40 of the main body 31 above the remaining amount detection portion 33. The atmosphere communication port 32 is a through hole which penetrates in the front-rear direction 53 through the wall defining the ink chamber 36. The airspace of the ink chamber 36 may communicate with the atmosphere via the atmosphere communication port 32. The atmosphere communication port 32 is configured to be openable and closable, for example, by an atmosphere communication valve. By opening the atmosphere communication port 32, the pneumatic pressure in the ink chamber 36 kept at a negative pressure becomes the atmospheric pressure.

On a lower wall 41 of the main body 31, a guided portion 44 is provided to extend along the front-rear direction 53. The guided portion 44 is constructed of a rib or projecting piece projecting downward from the lower wall 41. When the ink cartridge 30 is inserted into or removed from the cartridge installation section 110, the guided portion 44 is inserted into and moved in an aftermentioned guide groove 115 (see FIG. 3).

On an upper wall 39 of the main body 31, a guided portion 49 is provided to extend along the front-rear direction 53. The guided portion 49 is constructed of another rib or projecting piece projecting upward from the upper wall 39. When the ink cartridge 30 is inserted into or removed from the cartridge installation section 110, the guided portion 49 is inserted into and moved in another aftermentioned guide groove 115 (see FIG. 3).

<Cartridge Installation Section 110>

As shown in FIG. 1, the cartridge installation section 110 is provided in the printer 10. The ink is supplied from the ink cartridge 30 installed in the cartridge installation section 110 to the recording head 21. Further, FIG. 1 shows a state that the ink cartridge 30 is installed in the cartridge installation section 110.

Figure 3:
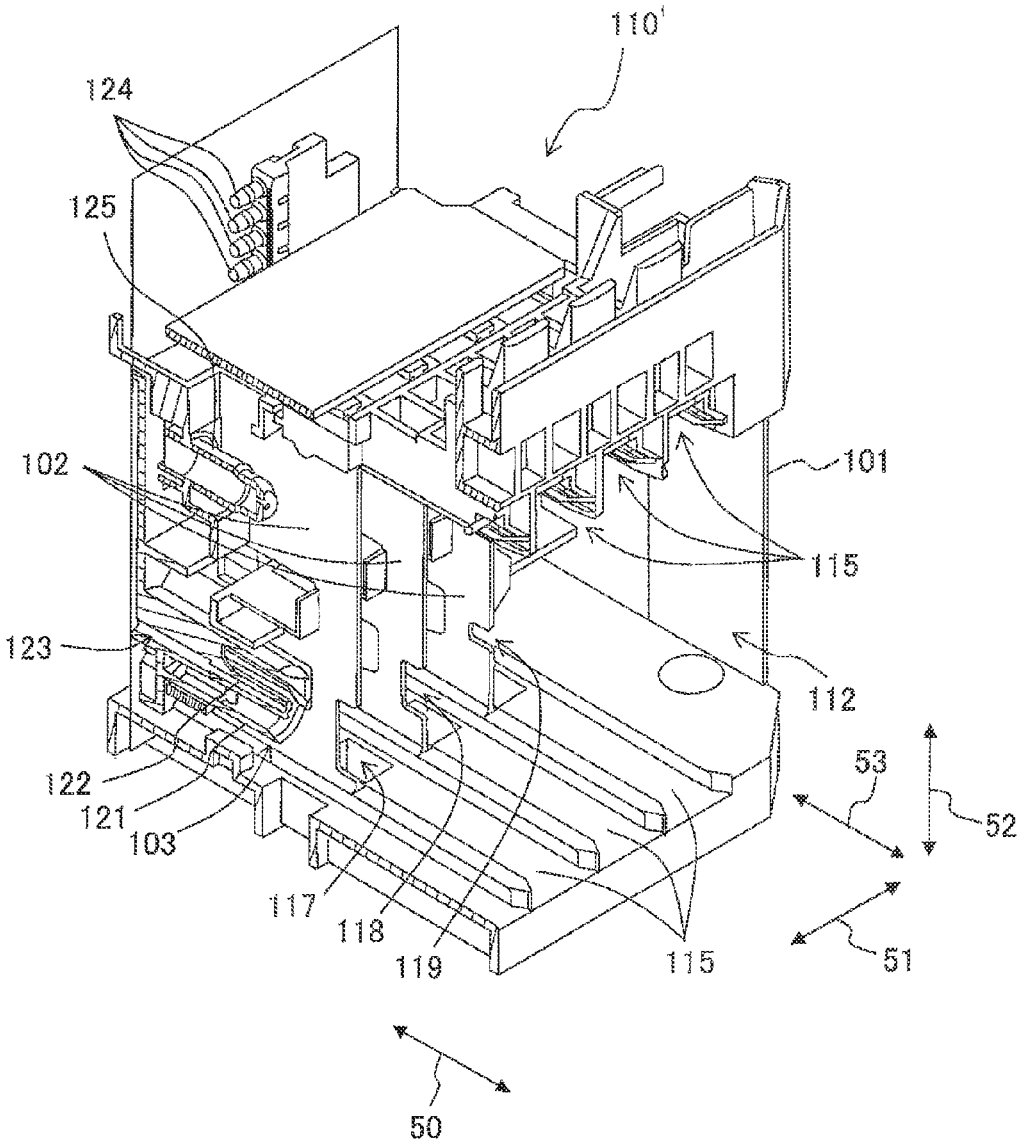
FIG. 3 is a perspective view with some parts in cross-section, showing a configuration of the cartridge installation section.

As shown in FIGS. 1 and 3, a case 101 forming the cartridge installation section 110 has the opening 112 at the front side of the printer 10. The ink cartridge 30 is inserted into or removed from the case 101 through the opening 112. The case 101 is capable of accommodating four ink cartridges 30 corresponding respectively to the colors of cyan, magenta, yellow and black.

In the top surface and the bottom surface of the case 101 constituently defining its internal space, guide grooves 115 are provided to correspond to the flour ink cartridges 30 respectively and to extend along the front-rear direction 53. Each of the ink cartridges 30 is guided in the front-rear direction 53, i.e., in the insertion and removal direction 50, by inserting the guided portion 49 and the guided portion 44 into a pair of the guide grooves 115 provided respectively on the top surface and the bottom surface of the case 101 in the internal space.

As shown in FIG. 3, in the case 101, three plates 102 are provided to partition the internal space into four spaces corresponding to the ink colors respectively, and each space is long in a vertical direction (in the up-down direction 52). The ink cartridges 30 are accommodated respectively in the spaces partitioned by these plates 102. The plates 102 are provided in the case 101 at the terminal side opposite to the opening 112.

The plates 102 have notches 117, 118 and 119, respectively, formed in their edge portions at the side of the opening 112 and at the lower side in the up-down direction 52 to dent toward the terminal side in the front-rear direction 53. The notches 117, 118 and 119 are different in dimension in the up-down direction 52. The plate 102 formed with the notch 118 is positioned, in the left-right direction 51, between the plate 102 formed with the notch 117 and the plate 102 formed with the notch 119. Among those notches, the notch 117 is the longest in the up-down direction 52. The notch 118 is shorter in dimension than the notch 117 in the up-down direction 52, and its lower end is positioned above the lower end of the notch 117. Among the three notches 117, 118 and 119, the notch 119 is the shortest in the up-down direction 52, and its lower end is positioned above the lower end of the notch 118. The edge of each of the plates 102 at the side of the opening 112 corresponds to an interference member.

Connection portions 103 are provided at the lower side, in the up-down direction 52, of a terminal surface of the case 101 formed at the terminal side. The connection portions 103 are arranged according to ink colors in positions corresponding, respectively, to the ink supply portions 37 of the ink cartridges 30 installed in the case 101. In this embodiment, four connection portions 103 are provided to correspond to the four ink cartridges 30 to be accommodated in the case 101.

Figure 4:
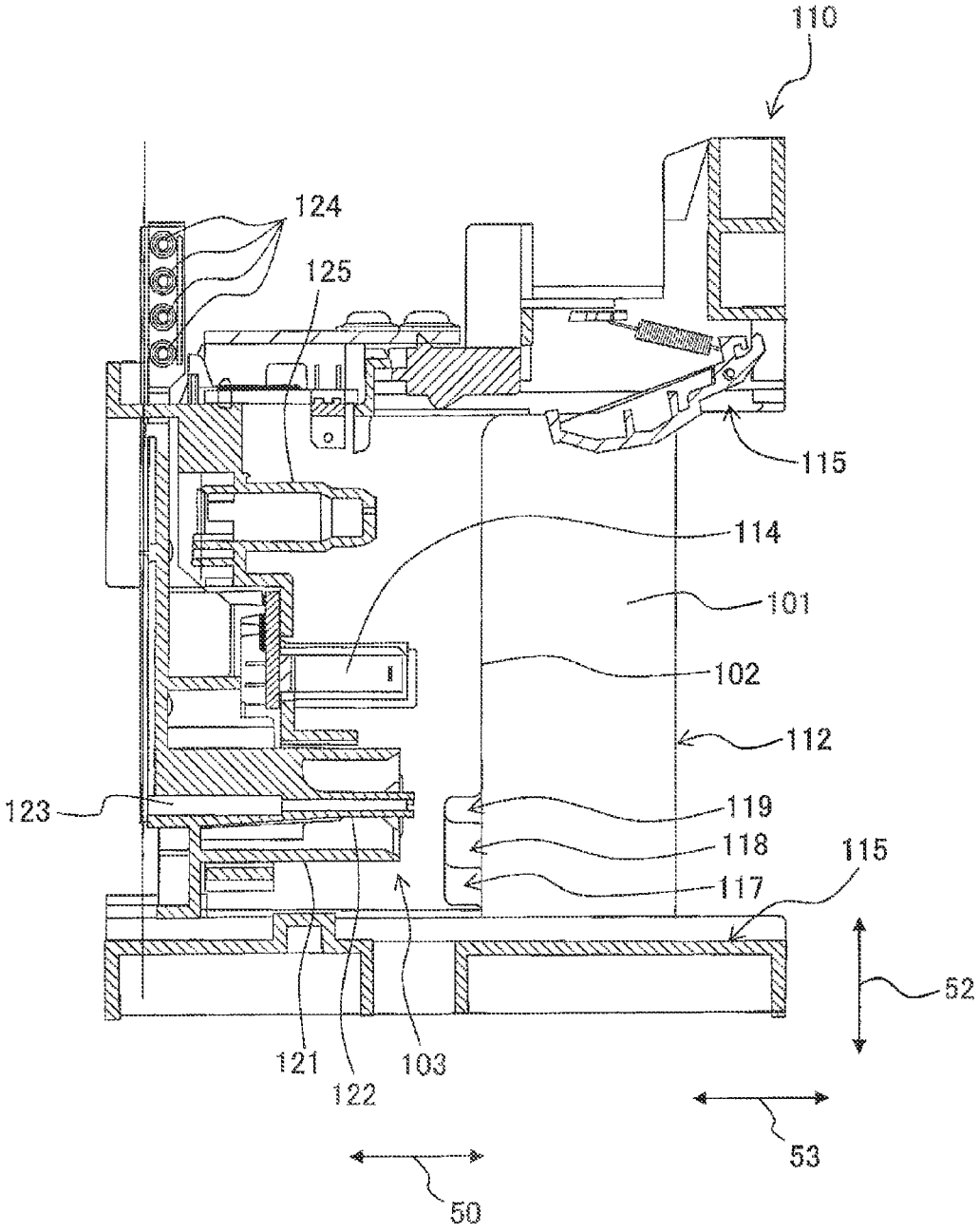
FIG. 4 is across-sectional view of the cartridge installation section.

As shown in FIGS. 3 and 4, each of the connection portions 103 has an ink needle 122 and a holding portion 121. Each ink needle 122 is formed of a tubular resin needle. As shown in FIG. 4, each ink needle 122 is connected to an ink flow passage 123 at an outer surface side opposite to the opening 112 of the case 101 (at the inner side of the terminal surface of the case 101). Each ink flow passage 123 extends upward until reaching a joint 124. One tube 20 is connected to each joint 124. Each of the ink needles 122 corresponds to the liquid supply tube.

As shown in FIG. 4, each of the holding portions 121 has such a shape as to form a recess in a cylinder from the anterior end to the other end. The ink needle 122 is arranged in the central portion of each of the holding portion 121. If the ink cartridges 30 are installed into the cartridge installation section 110, the ink supply portions 37 are inserted respectively into the recesses of the holding portions 121. On this occasion, the ink needles 122 are inserted respectively into the ink flow passages 38 of the ink supply portions 37 in such a state that the outer peripheries of the ink supply portions 37 are in respective contact with the inner surfaces defining the recesses of the holding portions 121, or in such a state that there are interspaces respectively between the outer peripheries of the ink supply portions 37 and the inner surfaces defining the recesses of the holding portions 121. By virtue of this, it becomes possible for the inks contained in the ink chambers 36 to flow out. The inks flowing out of the ink chambers 36 flow into the ink needles 122.

As shown in FIG. 4, on the terminal surface of the case 101, light sensors 114 are provided above the connection portions 103 in the up-down direction 52. Four light sensors 114 are arranged to correspond to the four ink cartridges 30 to be accommodated in the case 101. The four light sensors 114 are aligned in one row in the case 101 in the left-right direction 51 between the respective plates 102. Further, illustration of the light sensors 114 is omitted in FIG. 3.

Each of the light sensors 114 has a light emitting element such as LED or the like, and a light receiving element such as phototransistor or the like. If the remaining amount detection portion 33 enters an optical path of the light sensors 114 from the light emitting elements to the light receiving elements, it is possible for the light sensors 114 to detect a change in the amount of light transmitted through the remaining amount detection portion 33.

As shown in FIG. 4, rods 125 are provided on the terminal surface of the ease 101. The rods 125 are positioned to correspond in height to the atmosphere communication ports 32 of the ink cartridges 30 installed in the cartridge installation section 110. Four rods 125 are provided to correspond to the four ink cartridges 30 to be accommodated in the case 101. Each of the rods 125 has a cylindrical shape projecting from the terminal surface of the ease 101 toward the opening 112 along the insertion and removal direction 50. In the course of installing the ink cartridges 30 into the cartridge installation section 110, the rods 125 are inserted into the atmosphere communication ports 32 of the ink cartridges 30 so that the atmosphere communication valves are pushed in by the anterior ends of the rods 125 to open the atmosphere communication ports 32.

<Protective Cap 60>

A protective cap 60 is installed into the cartridge installation section 110 to be connected with the ink needles 122, in a state that the ink cartridges 30 are removed from the cartridge installation section 110. With the protective cap 60 installed in the cartridge installation section 110, during transportation, etc., of the printer 10, the inks are restrained from leaking out of the ink needles 122 into the internal space of the cartridge installation section 110, and the ink meniscuses in the nozzles 29 of the recording head 21 are restrained from being destroyed.

As shown in FIGS. 5 to 8, the protective cap 60 includes a ease 61, a film 62, a liquid absorbing member 63, and a handle 65.

The case 61 has a box-like shape with an opening 64 in the lower surface. The case 61 has an internal space in which the liquid absorbing member 63 is accommodated. With the opening 64 sealed up by the film 62, the internal space of the ease 61 becomes a liquid-tight chamber 66. The chamber 66 is defined by a first wall 71, a second wall 72, a sixth all 73, a fourth wall 74, a fifth wall 75, of the case 61, and the film 62 as a third wall. The case 61 and the film 62 correspond to the case.

With respect to the case 61, the first wall 71 is positioned at the front side (the front side in the front-rear direction 53) when the protective cap 60 is installed into the cartridge installation section 110. The second wall 72 is, in the front-rear direction 53, positioned at the opposite side to the first wall 71 with the chamber 66 intervening therebetween. The sixth wall 73 is positioned at the upper side in the up-down direction 52 and connects the first wall 71 and the second wall 72. The fourth wall 74 and the fifth wall 75 are a pair of walls facing each other in the left-right direction 51 and connect the first wall 71 and the second wall 72, respectively. By mutually connecting the first wall 71, second wall 72, sixth wall 73, fourth wall 74 and fifth wall 75, five surfaces of the chamber 66 are defined except for the opening 64.

The opening 64 is defined by the respective lower ends of the first wall 71, second wall 72, fourth wall 74 and fifth wall 75, while the film 62 is welded to the respective lower ends of the first wall 71, second wall 72, fourth wall 74 and fifth wall 75 to seal up the opening 64. In other words, the film 62 not only connects the first wall 71 and the second wall 72 but also connects the fourth wall 74 and the fifth wall 75. When viewed in the front-rear direction 53, the first wall 71 and the second wall 72 overlap at least in part with each other. When viewed in the up-down direction 52, the sixth wall 73 and the film 62 overlap at least in part with each other. When viewed in the left-right direction 51, the fourth wall 74 and the fifth wall 75 overlap at least in part with each other.

The handle 65 is provided on the second wall 72 of the case 61. The handle 65 has a wall extending outward along the front-rear direction 53 from a lower part of the second wall 72 of the case 61, i.e., a wall extending from the lower part of the second wall 72 toward the opening 112 in a state that the protective cap 60 is installed in the cartridge installation section 110. The handle 65 further has a wall extending upward in the up-down direction 52 from an end part of the wall extending in the front-rear direction 53.

The external dimension of the protective cap 60 in the front-rear direction 53 is smaller than the external dimension of the internal space of the cartridge installation section 110 in the front-rear direction 53. A user may insert his or her hand into the internal space of the cartridge installation section 110 from the opening 112, extend his or her finger between the second wall 72 and the upward extending wall of the handle 65, and pull the upward extending wall of the handle 65 toward the opening 112, so as to draw out the protective cap 60 installed in the cartridge installation section 110 from the cartridge installation section 110.

Figure 5:
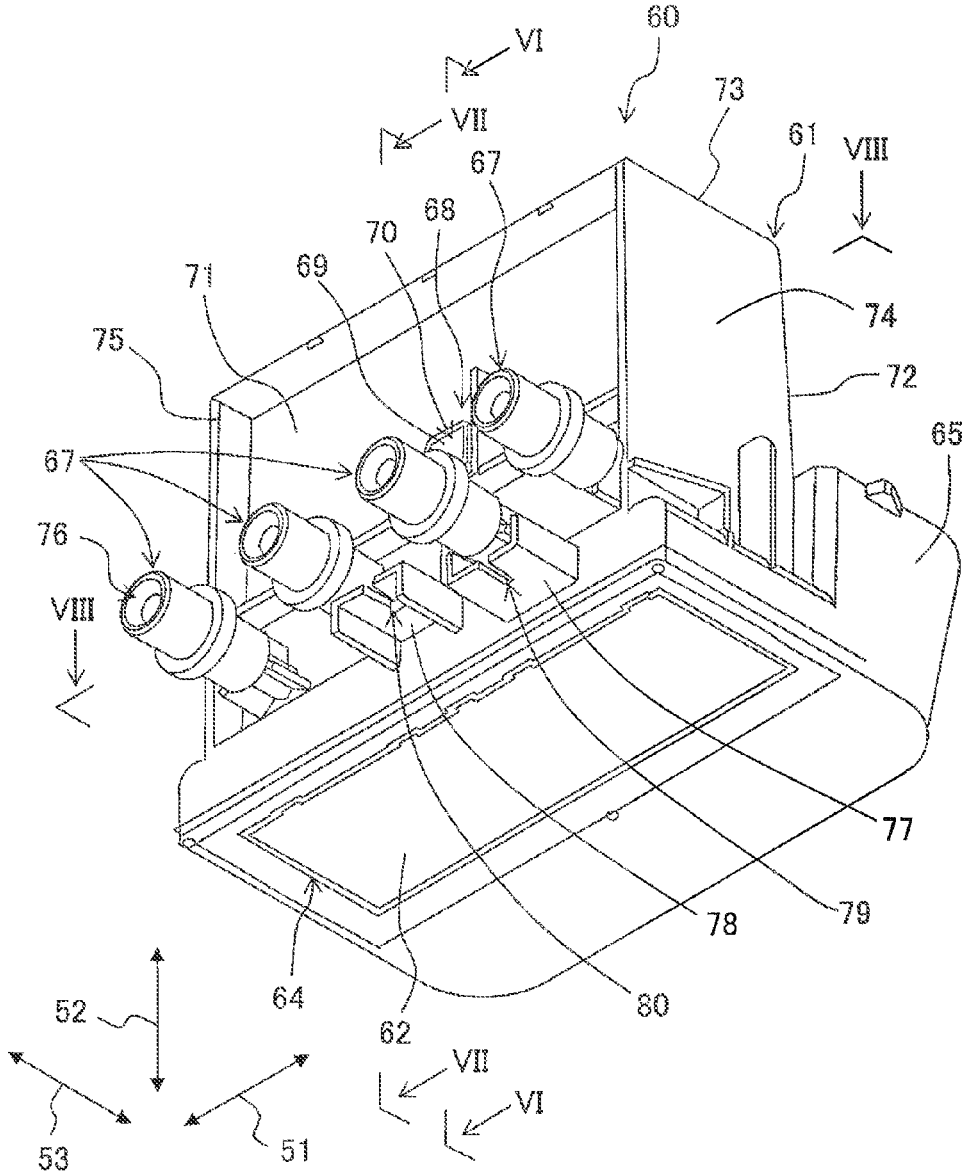
FIG. 5 is a perspective view showing a configuration of a protective cap.
Figure 6:
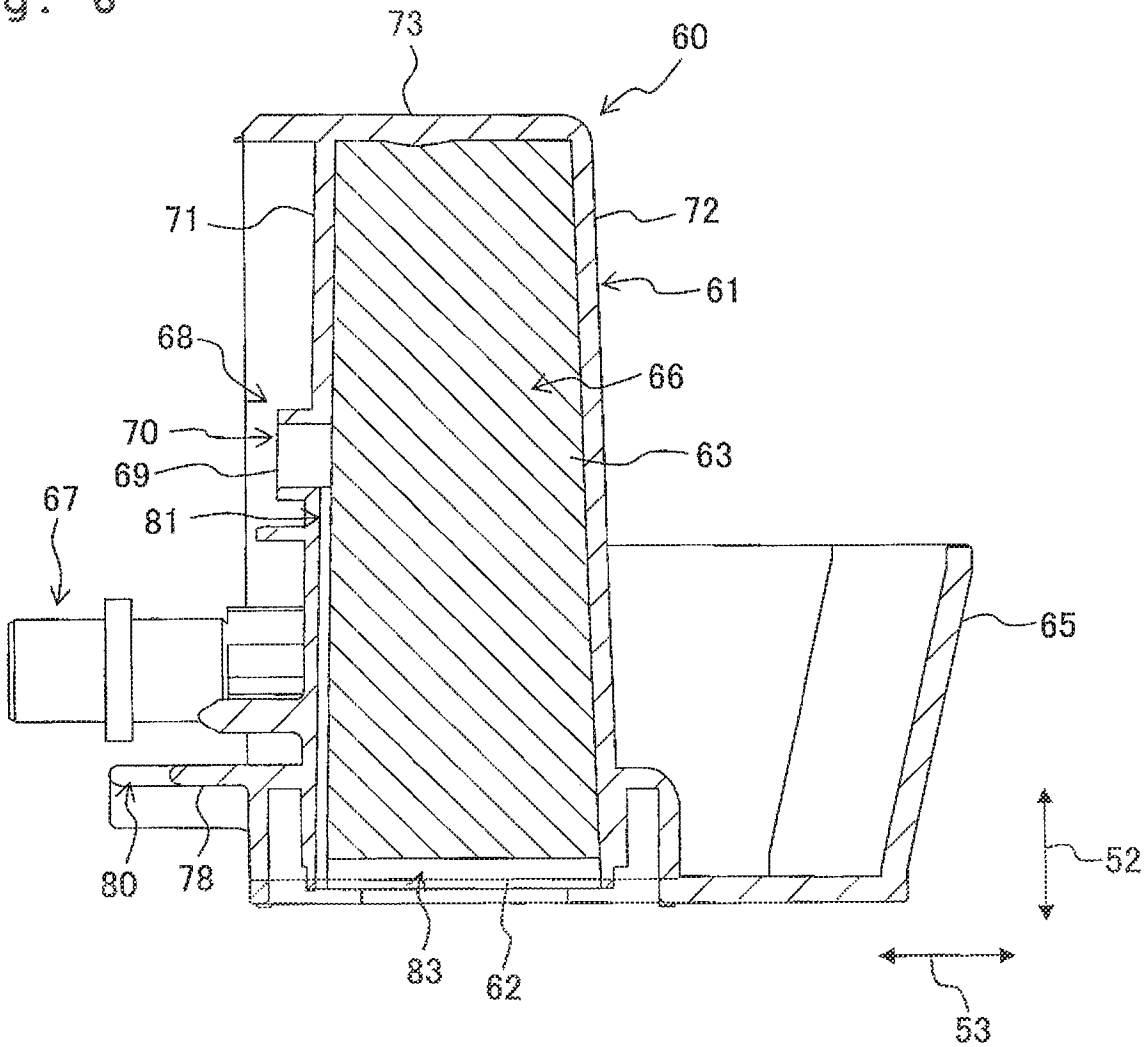
FIG. 6 is a cross-sectional view of the protective cap along the line VI-VI of FIG. 5, i.e., the cross-sectional view showing a cross-section passing through an atmosphere communication port and a groove.
Figure 7:
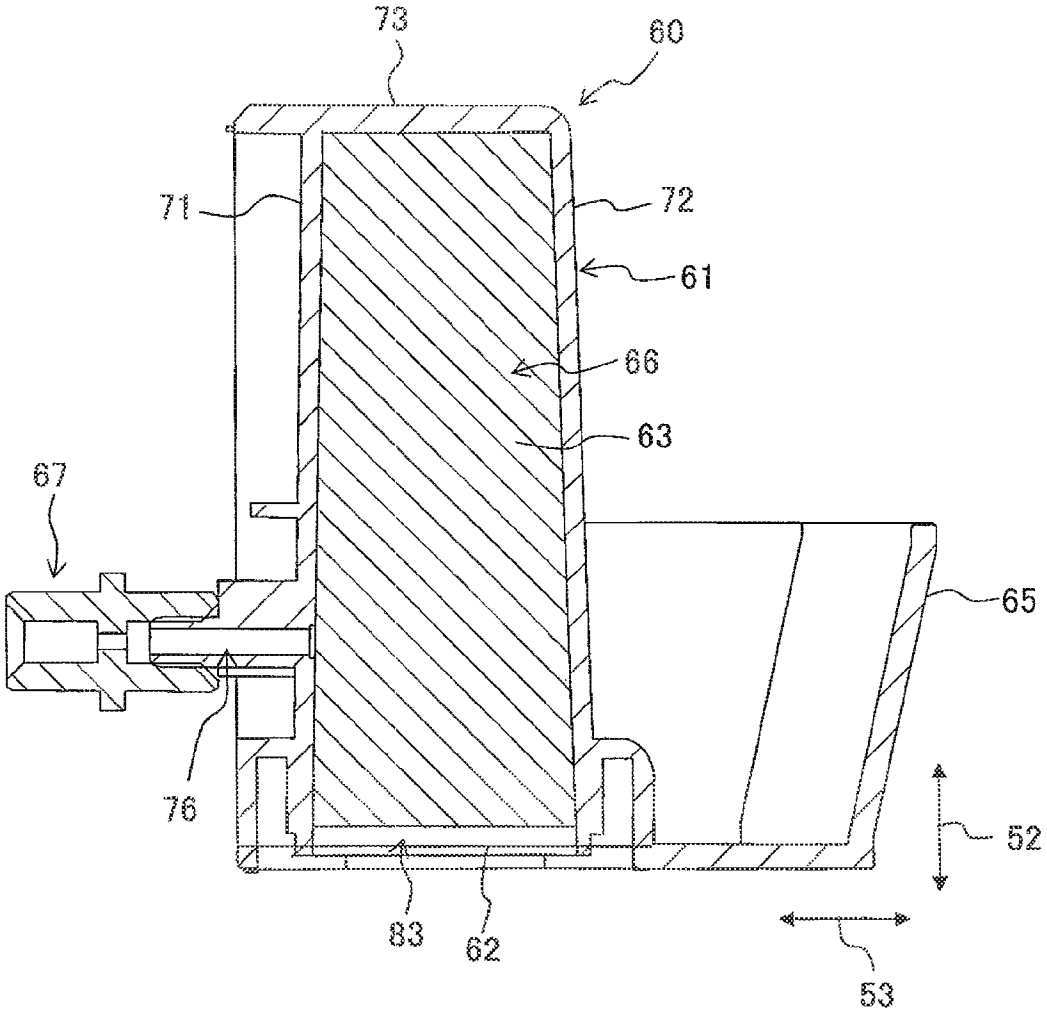
FIG. 7 is a cross-sectional view of the protective cap along the line VII-VII of FIG. 5, i.e., the cross-sectional view showing a cross-section passing through a connecting channel.

As shown in FIGS. 5, 6 and 7, the first wall 71 is provided with connecting portions 67 and an atmosphere communication portion 68. Four connecting portions 67 are arranged to align in one row in the left-right direction 51 to correspond to the four ink needles 122 provided in the cartridge installation section 110. Each of the connecting portions 67 has a cylindrical shape projecting outward along the front-rear direction 53 from a lower part of the first wall 71 in the up-down direction 52. Each of the cylindrical connecting portions 67 has an internal space which forms a part of a connecting channel 76 penetrating through the first wall 71 to communicate inside and outside of the chamber 66.

In more detail, four connecting channels 76 are in respective communication with the chamber 66. The chamber 66 is in communication with the outside of the protective cap 60 via the connecting channels 76. The connecting portions 67 projecting outward from the first all 71 are connected respectively to the ink needles 122 by engaging with the ink needles 122 of the cartridge installation section 110. In particular, the ink needles 122 come into the insides of the connecting portions 67, respectively, to let the connecting portions 67 contact with the outer peripheries of the ink needles 122. By engaging the connecting portions 67 with the ink needles 122, the internal spaces of the ink needles 122 are connected with the connecting channels 76 to let the inks flow therebetween. Further, because at least a part of each of the connecting portions 67 is formed of an elastic member, the connecting portions 67 contact with the outer peripheries of the ink needles 122 while undergoing elastic deformation.

The atmosphere communication portion 68 is provided in the approximate center of the first wall 71 in the left-right direction 51 and in the up-down direction 52. The atmosphere communication portion 68 includes an atmosphere communication port 70 penetrating through the first wall 71 to communicate inside and outside of the chamber 66, and a film 69 of semipermeable membrane to cover the atmosphere communication port 70. The film 69 of semipermeable membrane is formed with a plurality of microscopic pores which allow for permeation of air but resist permeation of any liquid such as ink or the like. A sufficiently longer time is needed for liquid such as ink or the like than for air to permeate the film 69. Therefore, even if some liquid such as ink or the like flows into the atmosphere communication port 70 from the chamber 66, the liquid will not soon flow out of the case 61 by virtue of the film 69.

As shown in FIG. 5, two claws 77 and 78 project outward from the first wall 71. The claws 77 and 78 are projecting pieces projecting outward from the first wall 71 along the front-rear direction 53, and their projecting anterior ends are formed respectively with notches 79 and 80 denting toward the first wall 71 along the front-rear direction 53. While the claws 77 and 78 are arranged on the first wall 71 in different positions in the left-right direction 51 and in the up-down direction 52, their dimensions in the front-rear direction 53 are the same and, furthermore, the dimensions of the notches 79 and 80 in the front-rear direction 53 are also the same.

If the protective cap 60 is installed in the regular position in the cartridge installation section 110 such that each of connecting portions 67 of the protective cap 60 is connected with the corresponding ink needle 122, the notch 79 of the claw 77 is consistent in position with the notch 117 of the plate 102 of the cartridge installation section 110 both in the left-right direction 51 and in the up-down direction 52. By virtue of this, the claw 77 does not interfere with the edge of the plate 102 at the side of the opening 112, and thus the edge of the plate 102 at the side of the opening 112 reaches a position nearer to the first wall 71 than the position of the notch 79. Likewise, the notch 80 of the claw 78 is consistent in position with the notch 118 of the plate 102 of the cartridge installation section 110 both in the left-right direction 51 and in the up-down direction 52. By virtue of this, the claw 78 does not interfere with the edge of the plate 102 at the side of the opening 112, and thus the edge of the plate 102 at the side of the opening 112 reaches a position nearer to the first wall 71 than the position of the notch 80.

On the other hand, even if it is attempted to install the protective cap 60 into the cartridge installation section 110 in such a state that the protective cap 60 is out of position in the left-right direction 51 and each of the connecting portions 67 of the protective cap 60 is connected to an adjacent ink needle 122 different from the corresponding ink needle 122, the notch 79 of the claw 77 is not consistent in position with the notch 118 of the plate 102 in the up-down direction 52. Therefore, a portion of the notch 79, which defines an edge on the side of the first wall 71, interferes with (i.e. contacts with) the edge of the plate 102 on the side of the opening 112 below the notch 118. Further, a portion of the notch 80, which defines an edge on the side of the first wall 71, interferes with (i.e. contacts with) the edge of the plate 102 on the side of the opening 112 below the notch 119. Therefore, it is not possible to insert the protective cap 60 to the terminal side of the internal space of the cartridge installation section 110 until the respective connecting portions 67 reach positions at which the respective connecting portions 67 connect with the ink needles 122. The notch 79 of the claw 77 and the notch 80 of the claw 78 correspond to a retreat portion.

Figure 8:
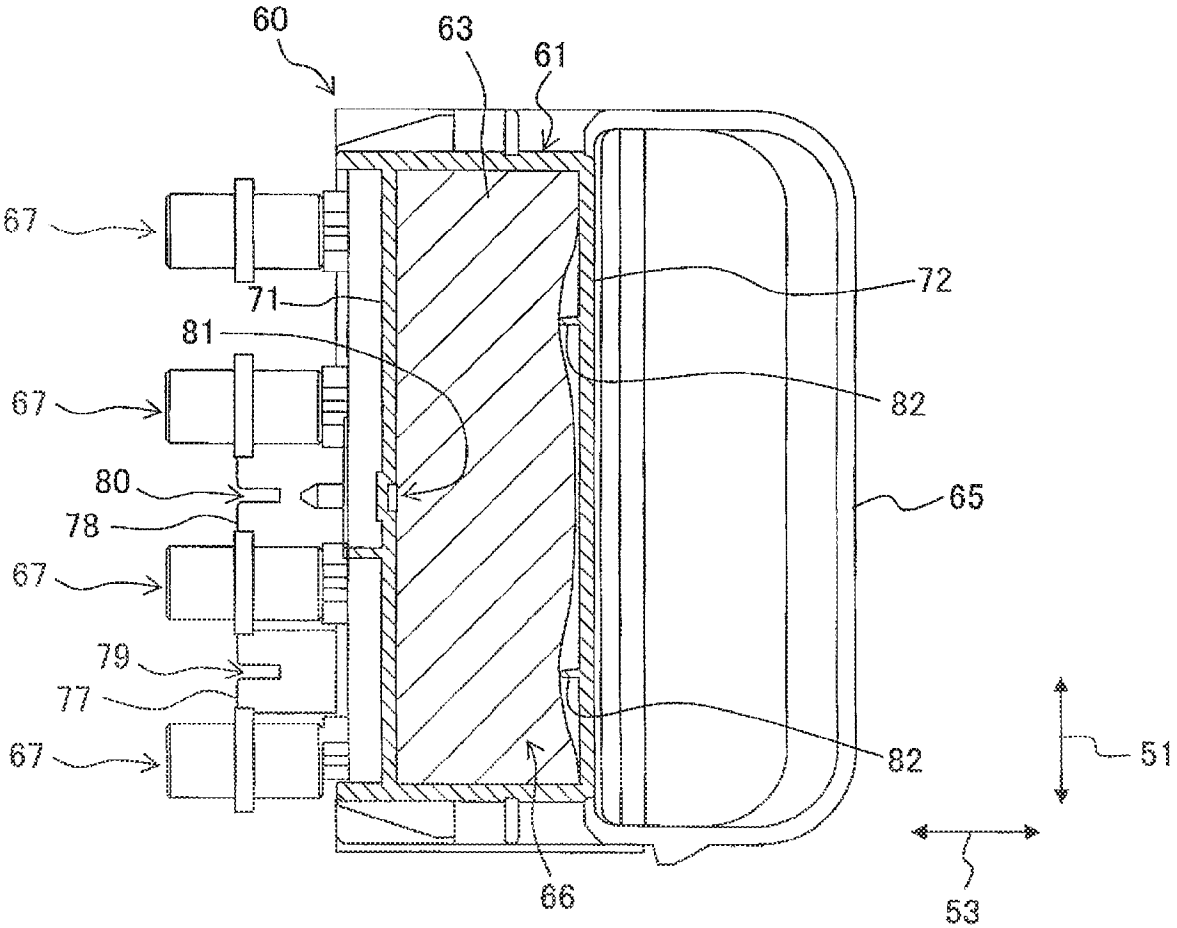
FIG. 8 is a cross-sectional view of the protective cap along the line of FIG. 5.

As shown in FIGS. 6 and 8, a groove 81 is provided in the first wall 71 of the case 61. Further, a pair of protruding pieces 82 is provided on the second wall 72 of the case 61 to protrude from the inner surface toward the chamber 66. The groove 81 extends from the opening 64 to the atmosphere communication port 70 linearly along the up-down direction 52 in the inner surface of the first wall 71, and opens to the chamber 66. The groove 81 has an internal space set to cause a capillary force (a three to guide a liquid by capillary action in the extending direction of the groove) to act on a liquid such as ink or the like. The internal space of the groove 81 corresponds to a first space.

Each of the pair of protruding pieces 82 has a rib-like shape extending on the inner surface of the second wall 72 from the opening 64 to the sixth wall 73 along the up-down direction 52. In spaces formed in corner portions between each of the protruding pieces 82 and the inner surface of the second wall 72, another capillary force acts on the liquid such as ink or the like. The capillary force acting on the liquid due to the pair of protruding pieces 82 is smaller in magnitude than the capillary force acting on the liquid due to the groove 81. It is possible to adjust the magnitude of the capillary forces by, for example, changing the width of the internal space of the groove 81, the angles formed between the protruding pieces 82 and the inner surface of the second wall 72, etc. The spaces formed around the pair of protruding pieces 82 correspond to a second space.

The chamber 66 of the case 61 is filled with the liquid absorbing member 63, it is possible to make the liquid absorbing member 63 by using, for example, a non-woven fabric having a three-dimensional network structure, a sponge having interconnected cells, or the like, which have microscopic spaces capable of retaining the liquid against the gravitational force by capillary force or surface tension. Under a condition that the liquid absorbing member 63 is not accommodated in the chamber 66, the liquid absorbing member 63 has an external shape in which the width in the left-right direction 51 and the length in the front-rear direction 53 are equal to or a little larger than those of the chamber 66 and the height in the up-down direction 52 is a little smaller than that of the chamber 66.

The liquid absorbing member 63 is capable of elastic deformation to shrink its external dimensions. The liquid absorbing member 63 does not enter the internal space (first space) of the groove 81. Further, the liquid absorbing member 63 fills the chamber 66 in such a state that the liquid absorbing member 63 is pressed by the protruding pieces 82 projecting toward the chamber 66 and thus elastically deformed to shrink in the front-rear direction 53. The liquid absorbing member 63 is not present in the space (second space) around each of the protruding pieces 82 in the vicinity of the second wall 72. That is, the first space is formed between the liquid absorbing member 63 and the first wall 71, while the second space is formed between the liquid absorbing member 63 and the second wall 72.

Aside from the groove 81 and the spaces around the protruding pieces 82, the liquid absorbing member 63 is in surface contact with the inner surfaces of the first wall 71, second wall 72, sixth wall 73, fourth wall 74, and fifth wall 75. Because the groove 81 is arranged in such a position as not to overlap with any of the connecting channels 76 penetrating through the first wall 71, the liquid absorbing member 63 is in surface contact with portions, of the inner surface of the first wall 71, around openings of the connecting channels 76, in other words, each of the connecting channels 76 opens to the chamber 66 in an area where the liquid absorbing member 63 contacts with the inner surface of the first wall 71.

As shown in FIG. 6, because the liquid absorbing member 63 contacts with the sixth wall 73 and has a shorter dimension than the chamber 66 in the up-down direction 52, it does not contact with the film 62 covering the opening 64 of the case 61. A space 83 formed between the liquid absorbing member 63 and the film 62 is continuously connected with the internal space of the groove 81 and with the spaces around the protruding pieces 82. That is, the internal space of the groove 81, the spaces around the protruding pieces 82, the space 83, and the atmosphere communication port 70 are in communication with one another so that the inks and air flow without going through the liquid absorbing member 63. Further, the groove 81 extends along a virtual straight line 54 connecting the atmosphere communication port 70 and the space 83 at the shortest distance (see FIGS. 10A, 10C, 10E and 10G). The capillary three generated in the space 83 is smaller than the capillary force generated in the groove 81. The space 83 corresponds to a third space.

<Installation of the Protective Cap 60>

Figure 9:
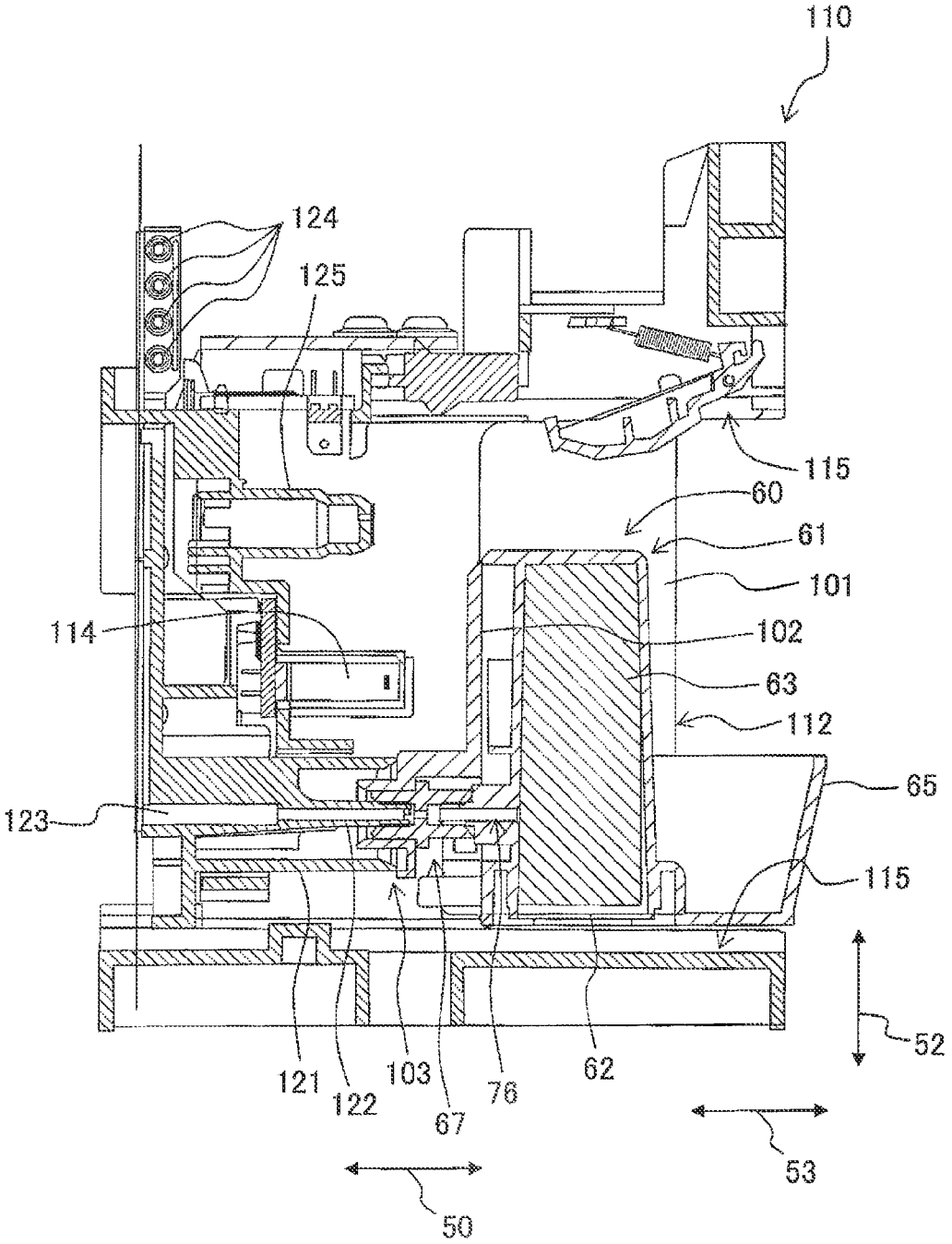
FIG. 9 is a cross-sectional view of the cartridge installation section with the protective cap installed.

As shown in FIG. 9, the protective cap 60 is installed in the cartridge installation section 110 in a state that the ink cartridges 30 are removed from the cartridge installation section 110. When the protective cap 60 is installed in the cartridge installation section 110, the connecting portions 67 are connected respectively with the corresponding ink needles 122. By virtue of this, the liquid such as ink or the like flowing out of the ink needles 122 flows into the chamber 66 through the connecting channels 76. Further, because the recording head 21 is capped after an image recording is completed normally, the recording head 21 is usually capped in a state that the protective cap 60 is installed in the cartridge installation section 110. Then, there are inks in the tube 20 and recording head 21.

Although the chamber 66 is liquid-tight everywhere except for the atmosphere communication port 70, it opens to the atmosphere through the film 69 covering the atmosphere communication port 70. Therefore, even if there is a change in the external environment of the printer 10 to cause a temperature rise or the like and the airspace of the sub-tank 28 of the recording head 21 increases in volume to exceed the capacity of the sub-tank 28, such an amount of ink as much as the increased volume will flow into the chamber 66 from the ink needles 122 through the tube 20, so as to expel the air in the chamber 66 to the outside of the case 61 through the atmosphere communication port 70. Therefore, there is no destruction of the ink meniscuses in the nozzles 29 of the recording head 21. Further, the ink flowing into the chamber 66 is retained by the liquid absorbing member 63.

On the other hand, in a case different from a gradual change in the external environment such as a temperature rise or the like, if there is a rapid change in the external environment such as some great impact is exerted on the printer 10 during transportation, etc., there is a possibility that the ink meniscuses in the nozzles 29 of the recording head 21 are destroyed. On this occasion, it is possible for much of the ink in the tube 20 and sub-tank 28 to flow into the chamber 66. The ink flowing into the chamber 66 is retained by the liquid absorbing member 63. Further, although it is rare, the tube 20 may change with the passage of time to crack at the place connected with the joint 124 or at the place connected with the recording head 21. If some air flows into the tube 20 from such a crack, although it is possible for much of the ink in the tube 20 to flow into the chamber 66, the ink flowing into the chamber 66 is retained by the liquid absorbing member 63.

As shown in FIGS. 10A to 10D, if some ink flows from the connecting portions 67 into the chamber 66 in the protective cap 60, due to the gravitational force, the flow-in ink is retained at first in a lower part of the liquid absorbing member 63 accommodated in the chamber 66. Then, as the ink flowing into the chamber 66 increases in quantity, the ink is retained upwardly from the lower part of the liquid absorbing member 63. Along with the flow-in of the ink, the air in the chamber 66 moves from the upper part of the chamber 66 toward the second wall 72 and, through the spaces around the protruding pieces 82, the space 83, and the internal space of the groove 81, to finally reach the atmosphere communication port 70 and flow out of the case 61. Further, the arrows shown in FIGS. 10A to 10D indicate the air flow.

Figure 10A:
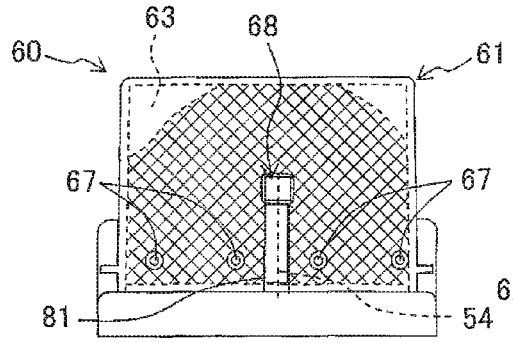
Figure 10B:
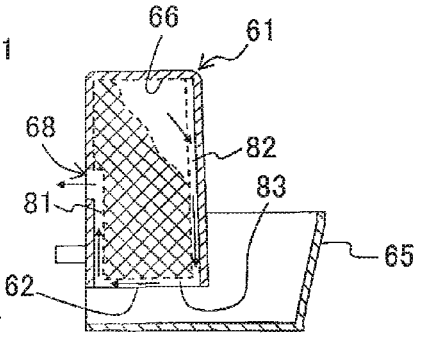
Figure 10C:
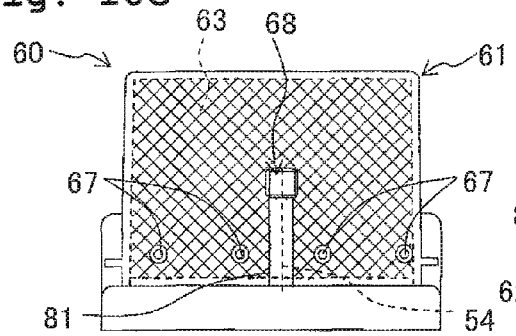
Figure 10D:
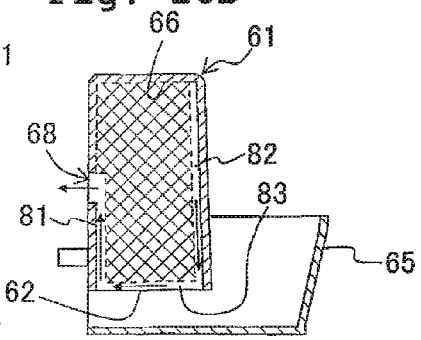
Figure 10E:
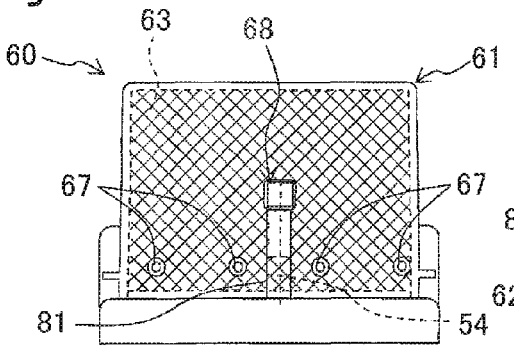
Figure 10F:
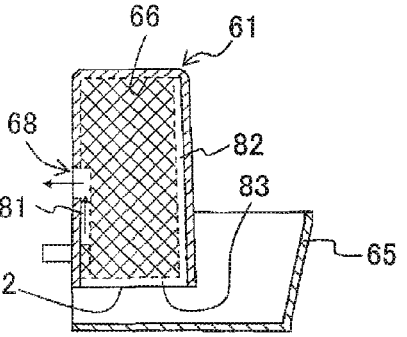

As shown in FIGS. 10E and 10F, if the ink flows into the chamber 66 and exceeds the amount of liquid retainable by the liquid absorbing member 63, the ink not retainable by the liquid absorbing member 63 flows into the internal space of the groove 81, because the capillary force generated by the groove 81 is greater than the capillary force generated by the spaces around the protruding pieces 82 and the space 83. Further, because the capillary force generated by the groove 81 is greater than the capillary force generated by the spaces around the protruding pieces 82 and the space 83, even if some of the ink flows into the spaces around the protruding pieces 82 and the space 83, that ink will flow toward the groove 81.

Figure 10G:
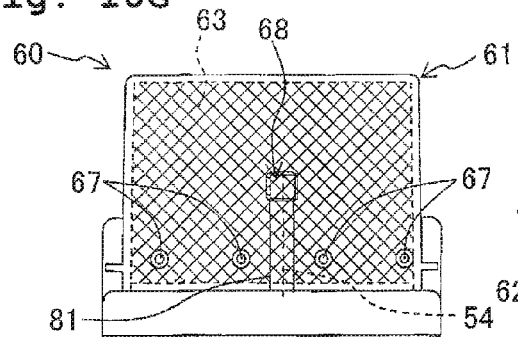
Figure 10H:
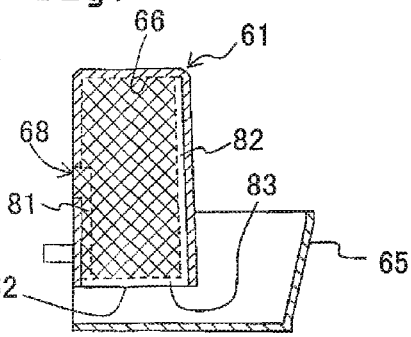

As shown in FIGS. 10G and 10H, the ink not retainable by the liquid absorbing member 63 flows along the groove 81 to reach the atmosphere communication port 70. Then, when the ink comes in contact with the film 69 covering the atmosphere communication port 70, the ink meniscuses are formed in the microscopic pores of the semipermeable membrane so as not to allow any air to pass through the film 69. Therefore, in the state shown in FIGS. 10G and 10H, even if the protective cap 60 is removed from the cartridge installation section 110 and the first wall 71 is postured downward, the ink in the ink chamber 66 is still restrained from leaking out of the connecting portions 67 and out of the atmosphere communication portion 68.

[Function and Effect of the Embodiment]

if the protective cap 60 in accordance with the present embodiment is installed in the cartridge installation section 110, the connecting portions 67 are connected with the ink needles 122. Because the atmosphere communication portion 68 allows the chamber 66 in communication with the connecting channels 76 to communicate with the outside of the case 61, if there is any increase in the volume or pressure of the air present in the recording head 21, tube 20, and sub-tank 28, the liquid such as ink or the like flows into the chamber 66 through the connecting channels 76. Therefore, it is possible to restrain the destruction of meniscuses of the liquid in the nozzles 29 of the recording head 21 and the leaking out of the liquid. Because the liquid flowing into the chamber 66 is absorbed by the liquid absorbing member 63, no liquid will leak out of the case 61. Further, even if the liquid meniscuses in the nozzles 29 of the recording head 21 is destroyed such that much of the liquid in the tube 20 and sub-tank 28 flows into the chamber 66, the liquid flowing into the chamber 66 is absorbed by the liquid absorbing member 63.

Further, in the atmosphere communication portion 68, because the film 69 of semipermeable membrane covers the atmosphere communication port 70 open to the outside of the case 61, the liquid flowing into the chamber 66 is restrained from leaking out of the case 61 through the atmosphere communication portion 68.

Further, since the connecting channels 76 and the atmosphere communication port 70 are provided in the first wall 71 defining the chamber 66, if the protective cap 60 is postured such that the first wall 71 faces downward, the liquid flowing into the chamber 66 comes in contact with the film 69 covering the atmosphere communication port 70 such that the chamber 66 comes into an air-tight state. By virtue of this, the liquid is restrained from leaking out of the chamber 66 through the connecting portions 67.

Further, since the internal space of the groove 81, the spaces around the protruding pieces 82, the space 83, and the atmosphere communication port 70 are in communication with one another without the liquid absorbing member 63 intervening therebetween, it is possible for the air at the side of the second wall 72 to promptly flow into and out of the atmosphere communication port 70. By virtue of this, it is possible to fully retain the liquid in the liquid absorbing member 63 accommodated in the chamber 66 up to a part, of the liquid absorbing member 63, on the side of the second wall 72.

Further, since the capillary force generated in the groove 81 is greater than the capillary three generated in the spaces around the protruding pieces 82 and the space 83, the liquid not retainable by the liquid absorbing member 63 in the chamber 66 smoothly flows into the groove 81, and promptly comes in contact with the film 69 covering the atmosphere communication port 70.

Further, since the groove 81 extends along a virtual straight line 54 linking the atmosphere communication port 70 and the space 83 at the shortest distance, it is possible for the groove 81 to have a smaller internal space in volume than a case in which the groove 81 extends along another path. That is, because it is possible for the internal space of the groove 81 to have a smaller amount of retainable liquid, in a case that the liquid lows into the chamber 66 and exceeds the amount of liquid retainable by the liquid absorbing member 63, the liquid will soon fill up the internal space of the groove 81 to reach the atmosphere communication port 70.

Further, because the protruding pieces 82 press the liquid absorbing member 63 toward the first wall 71, the liquid absorbing member 63 are appressed against the inner surface of the first wall 71, and thereby the liquid flowing into the chamber 66 from the connecting channels 76 is soon retained by the liquid absorbing member 63. Further, the spaces for air movement are also formed around the protruding pieces 82.

Further, since the connecting channels 76 of the connecting portions 67 open to the chamber 66 in areas where the liquid absorbing member 63 is in contact with the first wall 71, the liquid flowing into the chamber 66 from the connecting channels 76 is soon retained by the liquid absorbing member 63.

Further, since the plurality of connecting portions 67 are provided to correspond respectively to the plurality of ink needles 122, it is possible for the one protective cap 60 to retain the liquid flowing out of the plurality of ink needles 122.

Further, the case 61 has the claws 77 and 78 formed with the notches 79 and 80, and the claws 77 and 78 are formed not to interfere with the edges of the plates 102 at the side of the opening 112 in the cartridge installation section 110, only in connecting state that the plurality of connecting portions 67 are connected with the plurality of corresponding ink needles 122, respectively. Therefore, it is possible to prevent the protective cap 60 from being installed in the cartridge installation section 110 at a position deviated in the left-right direction 51.

[Modifications]

Further, in the above embodiment, the first wall 71 is provided with the groove 81, while the second wall 72 is provided with the protruding pieces 82. However, either the groove 81 or the protruding pieces 82 may be selectively provided.

Further, in the above embodiment, such an aspect is shown that the one protective cap 60 is installed in the cartridge installation section 110 provided with the four ink needles 122. However, it is also possible to adopt such an aspect that the protective cap 60 has, for example, one to three of the connecting portions 67, and a plurality of such protective caps 60 are installed in the cartridge installation section 110 provided with the four ink needles 122.

Further, in the above embodiment, the upper wall of the case 61 is the sixth wall 73 whereas the bottom wall is formed by the film 62 as the third wall. However, without being limited to this, for example, the bottom wall of the case 61 may be the sixth wall 73 whereas the upper wall may be formed by the film 62 as the third wall. That is, the opening 64 is defined by the respective upper ends of the first wall 71, second wall 72, fourth wall 74 and fifth wall 75, while the film 62 may be welded to the respective upper ends of the first wall 71, second wall 72, fourth wall 74 and fifth wall 75 to seal up the opening 64. In this case, the liquid absorbing member 63 may be arranged to contact with the sixth wall 73 which is the bottom wall, while the space 83 corresponding to the third space may be formed between the liquid absorbing member 63 and the third wall which is the upper wall.

Further, in the above embodiment, the explanation is made with the case that ink is present in the tube 20 and recording head 21. However, the same function and effect as those described above are also available for cases that some other liquid than ink is present in the tube 20 and recording head 21. As a liquid other than ink, a preservative solution may be taken, for example. The preservation solution is used to fill the tube 20 and recording head 21 when the printer 10 is shipped out. The preservative solution contains no or only a little dye and/or pigment which is ingredient of ink color, whereas the remaining ingredients of the preservation solution are the same as the ingredients other than the dye and/or pigment of ink. Further, a liquid other than ink may also be a preprocessing liquid to be jetted onto a sheet of recording paper or the like before the ink is jetted in image recording.

What is claimed is:

1. A protective cap configured to be connected to a liquid supply tube provided on a liquid cartridge installation section of a printer, the protective cap comprising:

a case having a chamber which is in a liquid-tight manner;

a liquid absorbing member provided in the chamber;

a connecting portion having a connecting channel in communication with the chamber and configured to be connected with the liquid supply tube; and an atmosphere communication portion via which the chamber communicates with an outside of the case;

wherein the atmosphere communication portion includes an atmosphere communication port opening to the outside of the case and a semipermeable membrane covering the atmosphere communication port.

2. The protective cap according to claim 1;

wherein the case includes:

a first wall provided with the connecting portion and the atmosphere communication port; and a second wall provided on a side opposite to the first wall with respect to the liquid absorbing member to sandwich the liquid absorbing member between the first wall and the second wall; and wherein the chamber is positioned between the first wall and the second wall.

3. The protective cap according to claim 2;

wherein the case includes a third wall connecting the first wall and the second wall;

wherein the chamber includes a first space, a second space, and a third space;

wherein the first space is formed along the first wall without being provided with the liquid absorbing member;

wherein the second space is formed along the second wall without being provided with the liquid absorbing member;

wherein the third space is formed along the third wall without being provided with the liquid absorbing member; and wherein the first space, the second space, the third space, and the atmosphere communication port are in communication with one another without the liquid absorbing member intervening therebetween.

4. The protective cap according to claim 3;

wherein the first space is an internal space of a groove formed in the first wall;

wherein capillary forces act in the first space, the second space, and the third space respectively to conduct the liquid by capillary action; and wherein the capillary force acting in the first space is greater than each of the capillary force acting in the second space and the capillary force acting in the third space.

5. The protective cap according to claim 4;

wherein the groove forming the first space extends along a virtual straight line connecting the atmosphere communication port and the third space by the shortest distance.

6. The protective cap according to claim 3;

wherein a protruding piece is provided on the case to protrude from the second wall toward the first wall; and wherein the second space is formed around the protruding piece by pressing the liquid absorbing member with the protruding piece.

7. The protective cap according to claim 3;

wherein the connecting channel of the connecting portion is open to the chamber in an area at which the liquid absorbing member contacts with the first wall.

8. The protective cap according to claim 3;

wherein the third space formed along the third wall is arranged below the connecting portion in a state that the protective cap is connected to the liquid supply tube.

9. The protective cap according to claim 3;

wherein the third wall is formed of a film.

10. The protective cap according to claim 1;

wherein the atmosphere communication port is arranged above the connecting portion in a state that the protective cap is connected to the liquid supply tube.

11. A protective cap configured to be connected to a liquid supply tube provided on a liquid cartridge installation section of a printer, the protective cap comprising:

a case having a chamber which is in a liquid-tight manner;

a liquid absorbing member provided in the chamber;

a connecting portion having a connecting channel in communication with the chamber and configured to be connected with the liquid supply tube; and an atmosphere communication portion via which the chamber communicates with an outside of the case;

wherein the connecting portion is provided as a plurality of connecting portions configure to be connected with a plurality of liquid supply tubes, which are provided to the liquid cartridge installation section, respectively.

12. The protective cap according to claim 11;

wherein the chamber is communicated with each of the plurality of connecting portions.

13. The protective cap according to claim 11;

wherein the case has a recessed portion configured not to interfere with an interference member provided to the liquid cartridge installation section only in a state in which the plurality of connecting portions are connected with the plurality of corresponding liquid supply tubes respectively.

14. The protective cap according to claim 13;

wherein the recessed portion is a notch; and wherein the interference member has another notch configured not to interfere with the notch of the case in the state in which the plurality of connecting portions are connected with the plurality of corresponding liquid supply tubes respectively.

* * * * *